United States Patent [19]

Cohn

[11] 4,453,553

[45] Jun. 12, 1984

[54] TREATMENT OF CIGARETTE PAPER

[76] Inventor: Charles C. Cohn, 123 S. New Hampshire Ave., Atlantic City, N.J. 08401

[21] Appl. No.: 473,934

[22] Filed: Mar. 10, 1983

Related U.S. Application Data

[63] Continuation-in-part of Ser. No. 460,423, Jan. 24, 1983, abandoned.

[51] Int. Cl.[3] ..... A24B 15/28

[52] U.S. Cl. ..... 131/365

[58] Field of Search ..... 131/365

[56] References Cited

U.S. PATENT DOCUMENTS

| | | | |
|---|---|---|---|
| 2,733,720 | 2/1956 | Schur | 131/365 |
| 4,129,134 | 12/1978 | Hind | 131/365 |
| 4,146,040 | 3/1979 | Cohn | 131/365 |
| 4,231,377 | 11/1980 | Cline et al. | 131/365 |

OTHER PUBLICATIONS

"Factors Affecting Static Burning," by Resnik et al.: *Tobacco Science,* 103-107, 10/1976.

*Primary Examiner*—Vincent Millin
*Assistant Examiner*—Harry J. Macey
*Attorney, Agent, or Firm*—Howson and Howson

[57] ABSTRACT

One version of a fire resistant cigarette comprises a charge of tobacco in a low-porosity wrapper substantially free of burn accelerator. The sidestream smoke from this cigarette can be reduced by treating the wrapper with water or ethyl alcohol. Fire resistance is further improved by depositing a linear burn rate reducing substance on the paper from the group consisting of citric acid, magnesium citrate, magnesium acetate, tartaric acid, acetic acid, lactic acid, a sugar, non-fat milk and skim milk. Similar results are achieved with conventional medium to high porosity cigarette papers by treating them with a burn rate reducing substance from the same group. In the case of high porosity cigarette paper, if only a part of the surface area is treated, the porosity of the untreated areas controls tar, nicotine, and carbon monoxide delivery. Still further improvements in sidestream smoke reduction and fire resistance may be achieved by the use of an additional layer of high-porosity cigarette paper in the wrapper.

13 Claims, No Drawings

TREATMENT OF CIGARETTE PAPER

CROSS REFERENCE TO RELATED APPLICATION

This is a continuation-in-part of my copending application Ser. No. 460,423, filed Jan. 24, 1983, now abandoned.

BRIEF SUMMARY OF THE INVENTION

This invention relates to the treatment of cigarette paper for fire resistance and for reduction of sidestream smoke, i.e. smoke emitted when the cigarette is not being puffed actively.

Existing treatments of cigarette paper and/or tobacco for fire resistance and sidestream smoke reduction are subject to one or more of the following problems. In some cases, the treatment results in a dark colored ash which is unacceptable to many smokers. In other cases, the treatment gives the cigarette an appearance which might be considered unacceptable by some smokers.

One object of this invention is to provide sidestream smoke reduction in a cigarette by a simple and inexpensive means and method which do not adversely affect the desirability of the cigarette to the smoker.

Another object of the invention is to provide a fire-resistant cigarette which is simple and inexpensive to manufacture, while avoiding the undesirable characteristics of prior fire-resistant cigarettes.

Another object of this invention is to impart both fire resistance and sidestream smoke reduction to a cigarette by a comparatively simple and inexpensive expedient, namely the use of a cigarette paper having special filler content and porosity characteristics, or by the treatment of cigarette paper with specially chosen chemical substances. It is also an object of this invention to achieve fire resistance and/or sidestream smoke reduction while maintaining a light colored cigarette ash. Still another object of the invention is to achieve fire resistance and/or sidestream smoke reduction without impairing the external appearance of the cigarette. Still another object is to achieve fire resistance and/or sidestream smoke reduction without causing excessive particulates in the mainstream smoke, and without seriously affecting the draw characteristics of the cigarette. In general, it is an object of the invention to achieve fire resistance and/or sidestream smoke reduction in a cigarette which is likely to be acceptable in all respects to most cigarette smokers. Still another object of the invention is to reduce the nicotine and tar delivery of a cigarette.

It is also an object of the invention to achieve one or more of the foregoing objects by a process which is easily and inexpensively carried out, and which does not have the alkalinity of the silicate treatments described in my U.S. Pat. Nos. 3,030,963, 3,183,914, 3,220,418, 4,044,778, 4,146,040 and 4,187,862.

One preferred cigarette in accordance with the invention, for fire resistance and the reduction of sidestream smoke, comprises a charge of tobacco in a wrapper of cigarette paper having a Greiner porosity of about 50 or more seconds and a weight between about 10 and 35 grams per square meter. The cigarette paper is substantially free of burn accelerator other than filler, and has a low filler content in the range of approximately 15 to 22%. Paper meeting the above requirements has been used in the past for wrapping cigarette filters. However, it apparently has not been used as a consumable wrapper for cigarette tobacco. I have found that low-porosity cigarette paper meets all of the above-stated objectives of the invention except for reduction of particulates in the sidestream smoke. I have also found that further improvements in performance of low-porosity, low-filler content paper can be achieved by treatment of the paper in water, ethyl alcohol, or in a solution or suspension of one or more of a wide variety of linear burn rate-reducing substances, as will be discussed in detail below.

I have also found that a specific class of burn rate-reducing substances is capable of achieving all of the above-listed objectives of the invention when used to treat conventional cigarette paper. This specific class of burn rate-reducing substances consists of lactic acid, citric acid, magnesium citrate, magnesium acetate, tartaric acid, acetic acid, non-fat milk, skim milk and sugars. If only part of the area of this cigarette paper is treated, fire resistance and/or sidestream smoke reduction can be achieved while producing substantially less particulate matter than would be present in the mainstream smoke from a cigarette with a wrapper treated over its entire area.

Although sugars can be used as burn rate-reducers on conventional cigarette papers for fire resistance and sidestream smoke reductions, when used in high concentrations, they tend to cause cigarette paper to darken when subjected to heat. However sugars in relatively high concentrations are entirely acceptable for treating brown cigarette papers.

Further objects and advantages of the invention will be apparent from the following detailed description.

DETAILED DESCRIPTION

For the purpose of this description and the claims, the following definitions shall apply:

"Cigarette paper" is defined as a tissue paper made from a highly beaten flax pulp stock, the paper being substantially free of pin holes and substantially free of sizing.

"Linear burn rate-reducing substance" means any substance which, when applied to cigarette paper and dried, causes the cigarette paper to exhibit a lower static burn rate than the same paper in an untreated condition. Such substances include citric acid, magnesium citrate, magnesium acetate, diammonium phosphate, trisodium phosphate, alumina gel, sodium tetraborate, ammonium hydroxide, nickel acetate, potato starch, sugar, aluminum stearate, manganese sulfate, ammonium sulfate, ammonium sulfamate, aluminum sulfate, acetic acid, lactic acid, and non-fat milk. Many other substances including sugars such as dextrose, maltose, sucrose, etc. also quality as linear burn rate-reducing substances. Burn rate-reducing substances have varying characteristics. All are applicable to low-porosity, low filler content cigarette paper. However, only a limited group of burn rate-reducers is applicable to conventional cigarette paper. The substances in this limited group which I have found produce good results are citric acid, magnesium citrate, magnesium acetate, tartaric acid, acetic acid, lactic acid, non-fat milks, skim milk, maltose, dextrose, sucrose, fructose and lactose.

"Filler" means calcium carbonate ($CaCO_3$) or any other substances used in the cigarette industry for the purpose of accelerating burning of paper. $MgCO_3$ and MgO are examples of other fillers which have been used.

"Greiner porosity" is a measure of cigarette paper porosity used throughout the cigarette industry. It refers to the time in seconds required for a specified volume of air to pass through a specified area of paper under a specified pressure. The higher the Greiner number, the lower the porosity of the paper.

"Sidestream smoke" is smoke emitted by a cigarette between puffs. This smoke does not pass through the tobacco rod or through the filter, and is considered particularly obnoxious by non-smokers. In testing for sidestream smoke the cigarette is puffed at the rate of one puff per minute and the sidestream smoke volume is evaluated visually. Sidestream smoke emitted before the second puff is taken is ignored.

"Drying" refers to the removal of moisture or liquid substances by the application of heat, by the application of moving air, by simply permitting evaporation to take place under ambient conditions, or by any other suitable means. However, "drying" does not imply the removal of all moisture. Rather, in the context of the following description, "drying" refers to the removal of moisture after treatment of cigarette paper to an extent such that the cigarette paper has substantially the same moisture content that it had prior to treatment.

The "fire resistance test" referred to herein is a test described in the Federal Trade Commission's Standard for the Flammability of Mattresses and Mattress Pads (FF 4-72), (16 C.F.R. 1632). The Federal Trade Commission's test is intended for testing mattresses using standard cigarettes. However, the test is equally applicable to the testing of cigarettes using standard mattresses, and a test on a standard mattress was used to determine the fire resistance of the cigarettes described in the examples herein. For the tests usd to determine fire resistance of cigarettes made in accordance with the invention the mattress material used is a cotton ticking covering a cotton batting. The lit cigarette, after at least 30 seconds of free burn time in air, is placed horizontally over the mattress ticking, with uniform contact of the cigarette paper with the ticking. The cigarette is permitted to burn until its self-extinguishes before full consumption, in which case it is relit and retested. It may burn its full length and then self-extinguish. The cigarette is observed to determine whether or not it causes smoldering or ignition of the test mattress.

The tests used to determine fire resistance and other parameters reported in the examples herein were carried out on cigarettes made by factory-type machines or on cigarettes made by hand using careful controls to insure a uniform tobacco packing density similar to that of a factory-made cigarette.

Certain criteria pertaining to burning characteristics must be met by a cigarette in accordance with the invention. The cigarette must burn for at least one minute between puffs. The linear burn rate must be between about 1 and 6 mm/minute. Further, in the case of a cigarette in accordance with the invention having a treated conventional wrapper, the linear burn rate must be substantially slower than the burn rate of a corresponding cigarette which has an untreated wrapper but which is otherwise identical to the cigarette having the treated wrapper. For example if an untreated cigarette has a burn rate of 5 mm/minute, a corresponding cigarette with a water-treated wrapper should be treated sufficiently to have a burn rate substantially less than 5 mm/minute, e.g. 4 mm/minute.

Although treated cigarettes will generally exhibit sidestream smoke reduction at a burn rate of 6 mm/minute or less, and some of the same cigarettes will also exhibit fire resistance at a burn rate anywhere in the range of 1 to 6 mm/minutes, other cigarettes must be treated sufficiently to have a burn rate as low as 3.5 mm/minute in order to have satisfactory fire resistance.

An important phase of this invention pertains to the use of a low porosity cigarette wrapper having a relatively low filler content.

Whereas the wrappers of conventional cigarettes have a Greiner porosity in the range of about 10 to 40 seconds, and a filler content (usually calcium carbonate, magnesium carbonate or magnesium oxide) in the range of approximately 22 to 35%, the preferred cigarette in accordance with this phase of the invention uses a wrapper having a Greiner porosity of about 50 or more seconds, and a filler content in the range of approximately 15 to 22%. The weight of the cigarette paper should be between about 10 and 35 grams per square meter as in the case of conventional cigarette paper. A typical paper having these characteristics is the so-called "plug wrap", which is used as a wrapper for cigarette filters, but has not been used as a wrapper for tobacco.

A cigarette having a wrapper consisting of such paper exhibits excellent fire resistance. When dropped on a test mattress, it may cause some charring, but does not start a fire, and eventually extinguishes itself.

In all of the examples herein, the cigarette tested was a king size cigarette having an average circumference of approximately 25 mm.

In the following examples of cigarettes using low-porosity paper, the tested cigarettes were made from conventional cigarettes by removing the tobacco and wrapper from the filter plug, wrapping the low-porosity paper around the filter to form a tube, sealing the tube edges together, and carefuully repacking the same tobacco in the tube to insure uniform tobacco density similar to that of the original cigarette. Where the paper was chemically treated, it was treated before replacement of the tobacco.

The following four examples pertain to king size cigarettes comprising tobacco wrapped in low-porosity, low-filler content cigarette paper. In each example, the weight given refers to the weight of the paper, including the calcium carbonate filler, in grams per square meter. The porosity is the Greiner porosity in seconds.

EXAMPLE 1

Weight=27 g./m$^2$
$CaCO_3$=18.5%
Porosity=50 sec.

EXAMPLE 2

Weight=35 g./m$^2$
$CaCO_3$=20.0%
Porosity=50 sec.

EXAMPLE 3

Weight=24 g./m$^2$
$CaCO_3$=20%
Porosity=50 sec.

EXAMPLE 4

Weight=24 g./m$^2$
$CaCO_3$=22%
Porosity=50 sec.

Cigarettes made in accordance with all of the foregoing examples exhibit substantially improved fire resistance when subjected to the fire resistance test described above. However, these cigarettes do not exhibit a substantial reduction in sidestream smoke. The lower calcium carbonate content in EXAMPLE 1 resulted in somewhat less charring of the test fabric than EXAMPLES 2, 3 and 4. I have found that the weight of the paper has little effect on its performance. When the calcium carbonate content of the paper is below approximately 15%, the paper does not burn for one minute, a minimum of one minute of burning under static conditions being an essential criterion for a satisfactory cigarette. If the calcium carbonate content substantially exceeds 22% in this low-porosity paper, the fire resistance of the paper is impaired.

Cigarettes in accordance with EXAMPLES 1 through 4 inclusive are simple to manufacture by conventional cigarette-making machinery, inasmuch as the only difference between these new cigarettes and conventional cigarettes is in the nature of the paper used to wrap the tobacco.

A cigarette using a low-porosity wrapper with a low filler content has the further advantage that it burns more slowly than a conventional cigarette, and therefore consumes less tobacco in a given number of puffs. It is not known whether or not any health benefits result directly from the reduced rate of consumption of tobacoo. However, the reduction in tobacco consumption makes it possible to use less tobacco in a cigarette of a given length, and to provide a longer and more effective filter.

While the use of low-porosity paper with a low filler content improves fire resistance, it has comparatively little effect on sidestream smoke production. However, in accordance with the invention, it is a simple matter to reduce sidestream smoke to very low levels by treating paper having low porosity and low filler content with water or ethyl alcohol, and thereafter drying the paper. A cigarette so treated meets the necessary burning criteria in that it burns for at least one minute without puffing, and has a linear burn rate in the range of about 1–6 mm. per minute.

Treatment of cigarette paper with water or ethyl alcohol is carried out simply by running the cigarette paper over and under rollers into a water or alcohol bath, and from there to a dryer which eliminates excess moisture or liquid content, bringing the moisture content of the cigarette paper back to its approximate original level.

The following two examples pertain to the treatment of low-porosity cigarette paper with water or ethyl alcohol.

EXAMPLE 5

Weight=27 g./m$^2$
$CaCO_3$=18.5%
Porosity=50 sec.
Treatment=soak paper with water and allow to dry before wrapping tobacco.

EXAMPLE 6

Weight=27 g./m$^2$
$CaCO_3$=18.5%
Porosity=50 sec.
Treatment=soak paper in 95% ethyl alcohol and allow to dry before wrapping tobacco.

In both of these examples, performance was similar to EXAMPLE 1 except that sidestream smoke was substantially reduced.

Depositing a linear burn rate reducing substance in or on the paper further improves fire resistance and, in some cases, also produced a further reduction in sidestream smoke. Deposition of the linear burn rate reducing substance can be carried out most conveniently, using a method similar to EXAMPLE 5, by dissolving or suspending the substance in the water in which the cigarette paper is soaked. A wide variety of substances can be used to reduce the linear burn rate of low-porosity cigarette paper. Examples of suitable treatments include the following. In each case, the weight of the cigarette paper was 27 g./m$^2$, its $CaCO_3$ content was 18.5%, and its porosity was 50 seconds. The paper was soaked in an aqueous solution of the linear burn rate-reducing substance, and allowed to dry before wrapping the tobacco.

| Example | Burn Rate Reducing Substance | Concentration | Approximate Range |
|---|---|---|---|
| 7 | lactic acid | 1% | 1%–30% |
| 8 | citric acid | 1% | 1%–10% |
| 9 | magnesium citrate $Mg_3(C_6H_5O_7)_2$ | 1% | 1%–10% |
| 10 | magnesium acetate | 3% | 1%–5% |
| 11 | tartaric acid | 1% | 1%–27% |
| 12 | acetic acid | 1% | 1%–20% |

In each of Examples 7–12 the effect of the linear burn rate-reducing substance was to reduce the charring of the material used in the fire resistance test. The low end of the range of concentrations is the approximate point at which a noticeable reduction in charring occurs. Increasing the concentration to a level above the minimum effective level produces little improvement and therefore there is no reason to use higher concentrations of burn rate-reducing substances, except in the case of magnesium acetate, where raising the concentration to 3% results in a noticeable further reduction in sidestream smoke. Increasing the concentration of any of these burn rate-reducing substances to levels significantly higher than the upper ends of the given ranges may have a detrimental effect on the appearance and texture of the cigarette paper.

There are many other linear burn rate reducing substances which can be applied to low-porosity cigarette paper from an aqueous solution. These include, for example, trisodium phosphate, disodium phosphate, diammonium phosphate, phosphoric acid, sulfuric acid, sodium hydroxide, borax, boric acid, ammonium hydroxide, nickel acetate, sodium silicate, ammonium sulfate, ammonium sulfamate and sodium dichromate. These substances should be applied in low concentrations, i.e. of the order of 1%, as higher concentrations tend to produce a darkening of the cigarette ash. (The substances of Examples 7–12 have little if any effect on ash coloration regardless of concentration.)

Any of the burn rate-reducing substances can be applied in very low concentrations by multiple treatment steps. That is the paper is soaked in a solution containing a low concentration of a burn rate reducing substance, allowed to dry, then soaked again in the same or another solution of a burn rate-reducing substance, and again allowed to dry.

Non-fat milk is also effective as a linear burn rate reducer for reducing charring of the material used in the fire resistance test. Non-fat milk can be conveniently applied as a suspension of non-fat dry milk in water. A typical analysis of non-fat dry milk (Carnation brand) is as follows:
Water: 3.16%
Protein: 36.16%
Lipids: 0.77%
Carbohydrates: 51.98%
Ash: 7.93%
An example of treatment of low-porosity cigarette paper with non-fat milk is as follows:

EXAMPLE 13

Cigarette paper with a Greiner porosity of 50 seconds, a weight of 27 g./m$^2$ and a $CaCO_3$ content of 18.5% was treated on one side in a suspension consisting of about 1% by weight of non-fat dry milk in water, and allowed to dry. This treatment leaves a glaze on the treated side of the paper. The cigarette using the treated paper produced noticeable less charring of the test material in the fire resistance test.

The concentration of non-fat dry milk can range from about 1% to about 20%, although higher concentrations within this range are not necessary. If a glazed appearance is not desired on the outside of the cigarette wrapper, the milk suspension can be applied to the side of the wrapper which ultimately faces toward the tobacco. Alternatively, both sides of the paper can be treated. Instead of non-fat dry milk, skim milk diluted with water can be used with equivalent effect.

Various insoluble linear burn rate reducing substances other than milk can be applied in a suspension. Examples of such substances are alumina gel, potato starch and aluminum stearate. A typical aqueous suspension of one of these substances contains about 1% by weight of the substance. When applied to low-porosity cigarette paper, these substances provide improved resistance to charring as well as some sidestream smoke reduction.

While cigarettes with low-porosity paper still tend to produce a great quantity of tar, this can be corrected by providing venting holes surrounding the filter in the conventional manner. Venting holes do not affect the fire resistance or sidestream smoke production of the cigarette.

Low-porosity wrappers have a relatively small effect on the draw characteristics of a cigarette, making it only slightly more difficult to draw a satisfactory amount of smoke into the mouth than in the case of an ordinary cigarette. The draw characteristics of all cigarettes in accordance with this invention, whether they be low tar, very low tar or high tar cigarettes, is similar to that of conventional cigarettes. In no event is the draw of a modified cigarette so difficult as to be seriously objectionable to ordinary smokers of that particular cigarette in its unmodified condition.

The same linear burn rate reducers used with low-porosity cigarette paper in EXAMPLES 7–12, produce fire resistance and sidestream smoke reduction when applied to the higher porosity papers used in ordinary cigarettes.

In the following examples of cigarettes using treated high-porosity papers, the tested cigarettes were treated by applying the treating substance directly to the wrapper of a factory-made cigarette without removing the wrapper or the tabacco. This procedure simulates the results achieved by treating cigarette paper and thereafter forming it into a cigarette, as would be done in manufacture.

In each of the following examples the cigarette paper had a Greiner porosity of 20 seconds, a weight of 24 g./m$^2$, and a $CaCO_3$ content of 25%. The paper was soaked in the indicated treating solution and allowed to dry.

| Example | Burn Rate Reducing Substance | Concentration | Sidestream Reduction | Fire Resistance Test | Problems |
|---|---|---|---|---|---|
| 14 | lactic acid | 28% | no | no | — |
| 15 | lactic acid | 29% | yes | no | — |
| 16 | lactic acid | 30% | yes | yes | — |
| 17 | lactic acid | 33% | — | — | glazes paper |
| 18 | citric acid | 12.2% | no | no | — |
| 19 | citric acid | 13.3% | yes | no | — |
| 20 | citric acid | 23.5% | yes | yes | — |
| 21 | citric acid | 28.1% | — | — | unsatisfactory appearance |
| 22 | Magnesium Citrate $(Mg_3(C_6H_5O_7)_2$ | 4.9% | no | no | — |
| 23 | Magnesium Citrate $(Mg_3(C_6H_5O_7)_2$ | 5.2% | yes | no | — |
| 24 | Magnesium Citrate $(Mg_3(C_6H_5O_7)_2$ | 10.56% | yes | yes | — |
| 25 | Magnesium Citrate $(Mg_3(C_6H_5O_7)_2$ | 13.5% | — | — | darkens paper |
| 26 | Magnesium Acetate | 12.6% | no | no | — |
| 27 | Magnesium Acetate | 22.5% | yes | no | — |
| 28 | Magnesium Acetate | 46.5% | yes | yes | — |
| 29 | Magnesium Acetate | 50.5% | yes | yes | — |
| 30 | Tartaric Acid | 14.0% | no | no | — |
| 31 | Tartaric Acid | 15.0% | yes | no | — |
| 32 | Tartaric Acid | 53.5% | yes | yes | — |
| 33 | Tartaric Acid | 60.0% | — | — | heat discolors wrapper |
| 34 | Acetic Acid | 13.0% | no | no | — |
| 35 | Acetic Acid | 16.7% | yes | no | — |
| 36 | Acetic Acid | 23.0% | yes | yes | — |
| 37 | Acetic Acid | 33.3% | — | — | taste too sour |

In EXAMPLES 14–37, comparatively low concentration of burn rate reducing substances are effective to reduce sidestream smoke. If more of the burn rate reducing substance is used the cigarette becomes capable of passing the fire resistance test. The following table indicates the approximate minimum concentrations of each substance to effect fire resistance, and to effect noticeable sidestream smoke reduction, assuming a paper having a Greiner porosity of 20 seconds, a weight of 24 g./m$^2$ and a $CaCO_3$ content of 25%, and assuming treatment is carried out by a single soaking step followed by drying:

| Burn Rate Reducing Substance | Minimum Concentration To Achieve Noticeable Sidestream Reduction | Minimum Concentration To Pass Fire Test |
|---|---|---|
| lactic acid | 29% | 30% |
| citric acid | 13% | 23% |
| magnesium citrate | 5% | 10% |
| magnesium acetate | 22% | 46% |
| tartaric acid | 15% | 53% |
| acetic acid | 16% | 23% |

These minimum concentrations are only approximate, and vary to some extent depending on porosity, amount of filler present, cigarette diameter, the type of tobacco, the presence of other additives in the paper or in the tobacco, and possibly other factors.

As in Example 13, milk can be used to treat high porosity cigarette paper to produce sidestream smoke reduction and fire resistance. Milk is applied to the cigarette paper by treating one or both sides of the paper in a suspension of milk in water. In the following examples, cigarette paper having a Greiner porosity of 20 seconds, a weight of 24 g./m$^2$ and a $CaCO_3$ content of 25% was treated in a single step by coating one side with a suspension of Carnation brand non-fat dry milk:

| Example | Concentration | Sidestream Reduction | Pass Fire Resistance Test | Problem |
|---|---|---|---|---|
| 38 | 3.5% | no | no | — |
| 39 | 8.9% | yes | no | — |
| 40 | 9.23% | yes | yes | — |
| 41 | 32.4% | — | — | unsatisfactory appearance |

Here again, a small concentration of the burn rate reducing substance produces noticeable sidestream smoke reduction, while a greater concentration imparts sufficient fire resistance to pass the standard test. The minimum concentration of milk necessary to pass the fire test is approximately 9.0%, assuming 20 seconds porosity, a weight of 24 g./m$^2$ and a $CaCO_3$ content of 25% in the paper. This minimum quantity will vary with porosity, amount of filler, cigarette diameter, tobacco type, additives, etc.

The use of non-fat dry milk as a burn rate reducer has a number of advantages over the use of other burn rate reducers such as citric acid, magnesium citrate, etc. The treated cigarette has a better appearance, and is smoother and easier to remove from the pack. It is resistant to moisture and has a longer shelf life, and its paper is more flexible than other treated papers. Furthermore, the paper retains its strength while wet during treatment with the non-fat dry milk suspension.

Where the paper is treated with a burn rate-reducing substance, it may be desirable from the standpoint of appearance of the cigarette, to apply the burn rate-reducing substance to one side of the cigarette paper, and to wrap the tobacco with this cigarette paper so that the treated side is toward the tobacco. These steps are especially desirable where the burn rate-reducing substance is in suspension or in solution in a relatively high concentration such as to form a visible deposit on the paper. These steps are also desirable because, with the treated side toward the tobacco, there is less tendency for the burn rate-reducing substance to affect the color of the cigarette ash. Higher concentrations of burn rate reducers can be used when the treated side of the paper is toward the tobacco. This method of treatment produces more effective smoke reduction and more effective fire resistance without materially affecting the appearance of the cigarette or its ash.

It is not necessary to treat the entire surface area of a sheet of cigarette paper in order to obtain the benefits of my invention. In fact, it is desirable, at least in the case of high-porosity cigarette paper, to apply the burn rate-reducing substance to only a part of the surface area of the paper so that the porosity of the untreated areas serves to control the amount of tar, nicotine and carbon monoxide delivered in each puff.

In paper treatments over only part of the paper's surface area, performance is affected to some extent by paper porosity, the amount of burn accelerator present in the paper or tobacco, and the tobacco composition. Performance of a filter cigarette is also affected by the presence or absence of perforations in the paper surrounding the filter of the cigarette or the porosity of that paper. Similarly the performance of non-filter cigarettes is affected not only by paper porosity but also by the presence or absence of perforations near the end of the cigarette closest to the smoker's mouth. In general, cigarettes can be classified as "high tar" cigarettes or "low tar" cigarettes depending on the above factors. Low tar cigarettes produce 15 mg. or less tar under standard tests used in the tobacco industry. High tar cigarettes produce tars from above 15 mg. to 28 mg. or more. The effect of partial treatments in accordance with this invention has been found to correlate with the tar content classification of cigarettes. The following are examples of cigarettes in which part of the surface area of the paper was treated with a burn rate-reducing substance:

EXAMPLE 42

Weight: about 24 g/m$^2$
$CaCO_3$: about 25%
Porosity: 20 seconds
Tar: Low
Treatment: Soak 90% of the surface area of the paper in a 23% solution of citric acid and allow to dry. Pattern of coating is in one longitudinal stripe 22.5 mm. wide with 2.5 mm. space.
Result: Linear burn rate is about 1.79 mm. per minute as compared with 6.16 mm. per minute for a corresponding untreated cigarette. The cigarette passed the fire resistance test and exhibited a noticeable reduction in sidestream smoke. 23% is about the lowest concentration at which fire resistance can be achieved with citric acid on a partially coated cigarette paper.

EXAMPLE 43

This example is similar to EXAMPLE 42, except that the concentration of citric acid was 33%. The linear burn rate was about 1.3 mm. per minute, and the cigarette passed the fire resistance test and exhibited low sidestream smoke. 33% concentration of citric acid in near the upper limit for acceptable cigarette appearance.

EXAMPLE 44

This example is similar to EXAMPLE 42 except that only 50% of the surface area of the wrapper was treated with citric acid in three longitudinal stripes 4.5 mm. wide. This cigarette did not pass the fire resistance test, and the reduction in sidestream smoke was not noticeable.

EXAMPLE 45

Weight: 24 g/m$^2$
$CaCO_3$: about 25%
Porosity: 30 seconds
Tar: High
Treatment: Soak 90% of the surface area of the paper in a 16.6% solution of citric acid and allow to dry. Pattern is in a longitudinal stripe 22.5 mm. wide with an untreated area 2.5 mm. wide.
Result: Linear burn rate is about 2.5 mm. per minute. The cigarette passed the fire resistance test and exhibited a substantial reduction in sidestream smoke.

EXAMPLE 46

This example is similar to EXAMPLE 45 except that the concentration of citric acid was 33%. The linear burn rate was about 2.18 mm. per minute, and the cigarette passed the fire resistance test and exhibited a substantial reduction in sidestream smoke. 33% is the upper limit of citric acid concentration for acceptable cigarette appearance.

EXAMPLE 47

This example is similar to EXAMPLE 45 except that only 54% of the area of the wrapper was treated with citric acid in evenly spaced longitudinal stripes 4.5 mm. wide. This cigarette passed the fire resistance test but did not exhibit an appreciable reduction in sidestream smoke.

EXAMPLE 48

This example is similar to EXAMPLE 45 except that the citric acid concentration was only 9.09%. The cigarette exhibited a substantial reduction in sidestream smoke, but did not pass the fire resistance test.

EXAMPLE 49

This example is similar to EXAMPLE 45 except that the citric acid concentration was 9.09% and the area of coverage was 75%, the treated areas being in a longitudinal stripe 18.7 mm. wide with a 6.3 mm. space. This cigarette failed the fire resistance test, and did not exhibit an appreciable reduction in sidestream smoke.

EXAMPLES 42–49 indicate that fire resistance and sidestream smoke reduction can be achieved with only partial coverage of the cigarette wrapper, provided that a sufficient concentration of citric acid is used and provided that the ratio of treated area of total wrapper area is sufficient. Concentration and area ratio are interrelated in that a high concentration of burn rate reducer is effective when applied over a comparatively small part of the total wrapper area, whereas lower concentrations of burn rate reducers can also be effective if a larger portion of the total wrapper area is treated. Partial area treatment reduces paper porosity only in the treated areas, leaving untreated areas with their porosities unaffected so that air passes through the paper into the smoke stream within the cigarette to control the amount of tars, nicotine and carbon monoxide in the smoke delivered to the smoker with each puff of the cigarette.

For low tar cigarettes, a greater quantity of burn rate reducer is generally needed than for high tar cigarettes, to produce fire resistance.

The same general observations as deduced from EXAMPLES 42–49 apply to the other substances which can be used to treat high-porosity cigarette paper, namely magnesium citrate, magnesium acetate, tartaric acid, acetic acid, lactic acid, and sugars.

I have found that with low tar cigarettes, a greater quantity of burn rate reducer is needed to effect sidestream smoke reduction than with high tar cigarettes. I have also found that high tar cigarettes with low-porosity paper require somewhat less treated area for sidestream smoke reduction than low tar cigarettes with low-porosity paper. However, if the high tar characteristic of a cigarette results from the absence of burn acceleration of the tobacco or from the burning characteristics of the tobacco the classification of the cigarette as a "high tar" or "low tar" cigarette has little bearing on the effect of area coverage in determining sidestream smoke reduction.

Treatment with milk as a burn rate reducer is different in that high concentrations of milk, while producing good fire resistance, tend to cause more sidestream smoke than intermediate concentrations. The following table of examples illustrates this result in a high tar cigarette. In the examples, cigarette paper having a porosity of 20 seconds, a weight of 24 g/m$^2$, and a $CaCO_3$ content of 25% was treated with Carnation non-fat dry milk in suspension by applying the suspension to the paper in evenly spaced longitudinal stripes 4.5 mm. wide separated by untreated areas 3.8 mm. wide.

| Example | Concentration of Suspension | % Area Treated | Sidestream Reduction | Pass Fire Resistance Test |
|---|---|---|---|---|
| 50 | 11% | 50 | good | no |
| 51 | 11% | 75 | good | yes |
| 52 | 11% | 90 | good | yes |
| 53 | 13% | 50 | good | yes |
| 54 | 13% | 75 | good | yes |
| 55 | 13% | 90 | good | yes |
| 56 | 14.9% | 50 | good | yes |
| 57 | 14.9% | 75 | good | yes |
| 58 | 14.9% | 90 | good | yes |
| 59 | 16.6% | 50 | borderline | yes |
| 60 | 16.6% | 75 | borderline | yes |
| 61 | 16.6% | 90 | borderline | yes |

At concentrations above 16%, sidestream smoke emission is increased to unsatisfactory levels. The highest practical concentrations non-fat dry milk is about 14.9% because at higher concentrations, the cigarette paper darkens adjacent to the burning coal of the cigarette, and this darkening may be considered objectionable.

Of the above examples, I prefer the cigarette of EXAMPLE 56 because the 50% area coverage permits air to enter the cigarette through the pores of the paper in an amount adequate to provide good control of tar, nicotine and carbon monoxide in each puff of the mainstream smoke.

The following examples correspond to EXAMPLES 50–61 except that the cigarette was a low tar cigarette.

| Example | Concentration of Suspension | % Area Treated | Sidestream Reduction | Pass Fire Resistance Test |
|---|---|---|---|---|
| 62 | 11% | 50 | unsatisfactory | no |
| 63 | 11% | 75 | unsatisfactory | yes |
| 64 | 11% | 90 | good | yes |
| 65 | 13% | 50 | unsatisfactory | yes |
| 66 | 13% | 75 | good | yes |

-continued

| Example | Concentration of Suspension | % Area Treated | Sidestream Reduction | Pass Fire Resistance Test |
|---|---|---|---|---|
| 67 | 13% | 90 | good | yes |
| 68 | 14.9% | 50 | good | yes |
| 69 | 14.9% | 75 | good | yes |
| 70 | 14.9% | 90 | good | yes |
| 71 | 16.6% | 50 | good | yes |
| 72 | 16.6% | 75 | good | yes |
| 73 | 16.6% | 90 | good | yes |

These examples demonstrate that for low tar cigarettes sidestream smoke reduction requires somewhat higher concentrations of burn rate reducer or greater coverage, and that sidestream smoke reduction becomes unsatisfactory as concentration increases at least for low percentages of area coverage.

Here, discoloration of the paper occurs at concentrations above about 16.6%, so that concentration is a practical maximum. I prefer the cigarette of EXAMPLES 66 and 68, as the areas of coverage in these examples allow adequate amounts of air to enter through the pores of the paper for tar, nicotine and carbon monoxide control.

In cigarettes with wrappers treated with a burn rate reducer over only part of the total wrapper area, I prefer to apply the burn rate reducer in parallel, evenly spaced, lines of at least 4 mm. in width, the lines extending in the direction of the length of the cigarette when the cigarette is formed.

The cigarettes of EXAMPLES 42–73 were 25 mm. in circumference. With cigarettes of less circumference (i.e. so-called "thin" cigarettes) somewhat lower concentrations of burn rate reducers and somewhat lower percentages of area coverage produce satisfactory results.

With "thin" cigarettes, fire resistance, sidestream smoke reduction and ash color characteristics similar to those of treated 25 mm. cigarettes can be produced with burn rate reducer concentrations cut in half. For example, a cigarette having a circumference of 20 mm. and a porous wrapper treated with a 3% solution of magnesium citrate performs similarly to a conventional 25 mm. cigarette with a porous wrapper treated with a 5.9% solution of magnesium citrate. Likewise, a 20 mm. cigarette treated with a 3.8% non-fat dried milk suspension performs similarly to a conventional 25 mm. cigarette treated with an 8.2% suspension of non-fat dried milk. A 20 mm. cigarette treated with a 10% solution of citric acid performs similarly to a 25 mm. cigarette treated with a 22% solution of citric acid.

Those cigarettes of EXAMPLES 42–73 which have satisfactory sidestream reduction and pass the fire resistance test, as well as other cigarettes in accordance with the invention which pass the fire resistance test, also produce a light-colored ash and do not have to be snuffed out. They consume less tobacco for a given number of puffs than an untreated cigarette, have satisfactory draw characteristics, and produce a volume of smoke in each puff similar to that produced by an ordinary cigarette with an untreated wrapper.

Treatment of cigarette paper in multiple successive steps gives rise to certain advantages. In particular effective sidestream smoke reduction and fire resistance can be achieved using low concentrations of burn rate reducers in solution or suspension. Porosity control can be achieved by partially covering the cigarette paper with a burn rate reducer in one step and good sidestream smoke reduction and fire resistance is insured by applying a burn rate retardant in a very low concentration over the entire area of the paper in a separate step. Desirably, although not necessarily, the partial coverage step is carried out by application of the burn rate reducer to the side of the paper which ultimately faces the tobacco, as this results in a cigarette having a better appearance.

Examples of multiple-step treatments include the following:

EXAMPLE 74

Cigarette paper for a low tar cigarette, with a Greiner porosity of 20 seconds, a weight of 24 g/m$^2$ and a $CaCO_3$ content of 25% was treated by applying a suspension of about 13% non-fat dry milk over 54% of the area of the paper on one side in evenly spaced longitudinal stripes 4.5 mm. wide with a spacing of 3.8 mm. Following drying, the opposite side of the paper was treated with a suspension of about 1% non-fat dry milk. The results were very similar to those produced in EXAMPLE 59. The partially treated side was toward the tobacco.

EXAMPLE 75

Cigarette paper in a low tar cigarette with a Greiner porosity of 20 seconds, a weight of 24 g/m$^2$ and a $CaCO_3$ content of 25% was treated by applying a suspension of 13% non-fat dry milk to one side of the paper in evenly spaced longitudinal stripes 4.5 mm. wide with a spacing of 3.8 mm. Following drying, the same side of the paper was treated with a 2.8% of non-fat dry milk over its entire area. The cigarette was formed with the treated side of the paper on the outside. Sidestream smoke reduction was satisfactory, but the cigarette failed the fire resistance test.

EXAMPLE 76

Treatment was the same as in EXAMPLE 75 except that the concentration of the suspension in the second step was 4.8%. Sidestream smoke reduction was satisfactory, and the cigarette passed the fire resistance test.

EXAMPLE 77

Treatment was the same as in EXAMPLES 75 and 76 except that the concentration in the first step was 11.1% and in the second step was 6.99%. Sidestream smoke reduction was even better than in EXAMPLES 75 and 76 and fire resistance was better than EXAMPLE 76 in that charring of the test material was noticeably less.

The following examples pertain to multiple treatments of cigarette paper with solutions of magnesium acetate.

EXAMPLE 78

Cigarette paper in a low tar cigarette with a Greiner porosity of 20 seconds, a weight of 24 g/m$^2$ and a $CaCO_3$ content of 25% was treated by applying a solution of 20% magnesium acetate in longitudinal stripes 4.5 mm. wide with a spacing of 3.8 mm., i.e. over 54% of the wrapper area. Following drying, a 9% solution of magnesium acetate was applied to the same side of the paper over its entire area. The cigarette was formed with the treated side of the paper on the outside. This cigarette failed the fire resistance test, but exhibited satisfactory sidestream smoke reduction.

EXAMPLE 79

Treatment was the same as in EXAMPLE 78 except that the concentration in the partial coverage step was 20% and the concentration in the full coverage step was 13%. This cigarette exhibited satisfactory sidestream smoke reduction and passed the fire resistance test.

The difference between EXHIBITS 78 and 79 is that EXHIBIT 78's second step used 9.9% magnesium acetate and the cigarette did not pass the fire resistance test. EXHIBIT 79 increased the concentration in the second step to 13%, and the cigarette passed both sidestream and fire resistance tests.

Partial coverage of the inside of a cigarette wrapper and full coverage of the outside, using magnesium acetate produces good results as demonstrated by the following example.

EXAMPLE 80

Cigarette paper in a low tar cigarette with a Greiner porosity of 20 seconds, a weight of 24 g/m$^2$, and a $CaCO_3$ content of 25% was treated by applying a solution of 26% magnesium acetate to one side of the paper in longitudinal lines 4.5 mm. wide with a 3.8 mm. spacing. Following drying the opposite side of the paper was treated by applying a solution of 9.9% over its entire area. The cigarette was formed with the partially treated side toward the tobacco. This cigarette exhibited satisfactory sidestream smoke reduction and passed the fire resistance test.

Sugars can be used as burn rate-reducers as illustrated by the following table of examples. In these examples, the paper porosity was 20 seconds, the $CaCo_3$ content was 25% and the weight of the paper was 24 g/m$^2$. The entire area of the paper was soaked in a solution of the designated sugar in the concentration indicated. The paper was then allowed to dry, and fire resistance and sidestream smoke tests were carried out.

| Examples | Sugar | Concentrations | Sidestream Reduction | Fire Resistance |
|---|---|---|---|---|
| 81 | Dextrose | 30% | Yes | No |
| 82 | Dextrose | 50% | Yes | Yes |
| 83 | Sucrose | 30% | Yes | No |
| 84 | Sucrose | 50% | Yes | Yes |
| 85 | Maltose | 20% | Yes | No |
| 86 | Maltose | 25% | Yes | Yes |
| 87 | Maltose | 35% | Yes | Yes |

In each of these examples, the cigarette produced a white ash with an acceptable appearance.

The practical upper limit for sugar concentration is about 60%, because highly concentrated sugar solutions are hard to dry and tacky.

Sugar solutions may be applied in two steps, with the coverage in one of the steps being partial. Examples are as follows:

EXAMPLE 88

Cigarette paper for a low tar cigarette having a porosity of 20 seconds, a $CaCo_3$ content of 25% and a weight of 24 g/m$^2$ was treated with a solution of 50% dextrose over 75% of its area in longitudinal stripes 6 mm. wide with 2 mm. spacings between them. The paper was dried and then treated over its entire area with a 33% solution of sucrose and again dried. A cigarette with the treated paper as a wrapper exhibited good sidestream smoke reduction and passed the fire resistance test.

EXAMPLE 89

This example is similar to EXAMPLE 88 except that maltose was used instead of dextrose. The results were similar to those in EXAMPLE 88.

EXAMPLE 90

The treatment was similar to that in EXAMPLES 88 and 89 except that the treating solution in both steps was 33⅓% sucrose. The results were similar to those in EXAMPLES 88 and 89.

The lower concentration limit for each of the treatment steps in multiple treatments using sugars is dependent on the concentration in the other step. However, in general the lower limit of concentration for the partial treatment step is about 30% while the lower limit of concentration for the full treatment step is around 20%.

An additional layer of conventional cigarette paper can be used to improve the performance of a cigarette using low-porosity paper or of a cigarette using treated high-porosity paper. The use of an additional layer of cigarette paper in a cigarette having low-porosity paper is illustrated by the following example:

EXAMPLE 91

This cigarette had an inner wrapper having the following characteristics:
Weight: 24 g/m$^2$
$CaCO_3$: 20%
Porosity: 50 sec.
The outer wrapper was in close contact with the inner wrapper and consisted of high-porosity cigarette paper having the following characteristics:
Weight: about 24 g/m$^2$
$CaCO_3$: about 25%
Porosity: 20 sec.
This cigarette exhibited substantially improved fire resistance, and produced substantially less sidestream smoke than the cigarette of EXAMPLE 3, which had a single low-porosity wrapper.

The use of an additional wrapper also improves the performance of a cigarette having specially treated cigarette paper as illustrated by the following example:

EXAMPLE 92

In this example, the inner wrapper consisted of cigarette paper having a porosity of 20 seconds, a weight of 24 g/m$^2$ and a $CaCO_3$ content of 25%, soaked in a 4.5% solution of magnesium citrate ($Mg_3(C_6H_5O_7)_2$). The outer wrapper consisted of similar paper without magnesium citrate. The outer wrapper and inner wrapper were in close contact with each other. This cigarette produced good fire resistance and good sidestream smoke reduction. When this example is compared with EXAMPLE 22, it will be seen that the outer wrapper has the effect of reducing the concentration of the burn rate-reducing substance required to achieve fire resistance and sidestream smoke reduction.

I have found that the inclusion of an additional wrapper improved the performance of cigarettes using burn rate-reducing substances other than magnesium citrate. I have also found that the treated wrapper can be placed on the outside, and the untreated wrapper on the inside without materially affecting the performance of the cigarette. An additional wrapper can be used with a cigarette the wrapper of which is treated over part of its area as described above, with similar improved results.

In all cases of cigarettes which are treated with burn rate reducers in the group consisting of citric acid, magnesium citrate, magnesium acetate, tartaric acid, acetic acid, lactic acid, a sugar, or a suspension of non-fat milk or skim milk, the concentrations of these primary burn rate reducing substances can be reduced without impairing performance if other burn rate reducing agents are present. Examples of applicable burn rate reducing agents which may be added are monoammonium phosphate, diammonium phosphate, ammonium sulfamate, boric acid, and sulfamic acid. For example, instead of using 22% citric acid on a conventional porous 25 mm. cigarette, similar results in fire resistance, sidestream reduction and ash coloration are produced by treating the cigarette wrapper with a solution comprising about 9% citric acid and 5% ammonium sulfamate.

Burn rate reducers in the primary group (citric acid, magnesium citrate, magnesium acetate, tartaric acid, acetic acid, lactic acid, sugars, non-fat milk and skim milk) may also be used in combination as demonstrated by the following examples.

EXAMPLE 93

A "Winston Lights" cigarette wrapper was coated over its entire area with aqueous solution comprising 12% citric acid and 8% sucrose. The slower burn rate of the cigarette resulting from the treatment of the wrapper made it possible to reduce the length of the tobacco rod by 10 mm. from 53 mm. to 43 mm., and to increase the length of the filter by 10 mm. from 22 mm. to 32 mm. Whereas the original cigarette produced 8 puffs, the new cigarette produced 10 puffs. It passed the fire resistance test. Sidestream smoke from the new cigarette was faintly visible. Ash coloration, puff volume and draw characteristics were similar to those of the original cigarette, and the taste was somewhat milder. The free burn time of the new cigarette was about 3 minutes, and the linear burn rate was about 3 mm. per minute, as contrasted with a linear burn rate of about 5.3 mm. per minute for the original cigarette. This was a reduction of about 43%, a 40% reduction being a desirable minimum degree of reduction.

EXAMPLE 94

Another Winston Lights cigarette wrapper was treated over its entire area with an aqueous solution of 3% magnesium citrate and 12.2% citric acid. This cigarette produced low sidestream smoke and good fire resistance. The tobacco rod was 15 mm. shorter than that of a conventional Winston Lights cigarette, while the filter was 15 mm. longer. The cigarette produced 14 puffs. Taste was satisfactory. Ash coloration, puff volume and draw characteristics were similar to those of the original cigarette. The free burn time was approximately 3 minutes and the linear burn rate was 1.7 mm./minute.

The ability to shorten the tobacco rod and lengthen the filter, mentioned in the last two examples, applies to all cigarettes in which the linear burn rate is reduced by treatment of the wrapper or by use of a special wrapper. Although the slower burn rate produces a greater quantity of tar the greater length of the filter compensates for the increase in tar with the result that the smoke delivered to the smoker has a lower quantity of tar in each puff. Still further reductions may be achieved by treating only part of the wrapper area as explained above with reference to EXAMPLES 42–90.

I claim:

1. A cigarette comprising a charge of tobacco in a wrapper of cigarette paper having a Greiner porosity of at least about 50 seconds and a weight between about 10 and 35 grams per square meter, said paper being substantially free of burn accelerator other than filler and having a filler content in the range of approximately 15 to 22 percent.

2. A cigarette according to claim 1 in which the wrapper is prepared by coating at least part of the surface of said cigarette paper with water or ethyl alcohol and thereafter drying said cigarette paper.

3. A cigarette according to claim 1 in which the wrapper is prepared by depositing a linear burn rate-reducing substance in or on the paper by coating at least part of the surface of the paper with a solution or suspension of said substance.

4. A cigarette according to claim 1 in which the wrapper is prepared by depositing a linear burn rate reducing substance in or on the paper by coating at least part of the surface of the paper with a solution of citric acid, magnesium citrate, magnesium acetate, tartaric acid, acetic acid, lactic acid or a sugar, or a suspension of non-fat milk or skim milk.

5. A cigarette according to claim 1 having an additional layer of paper in contact with substantially the entire surface area of said wrapper on one side thereof, said additional layer of paper being a cigarette wrapper having a Greiner porosity of about 10 to 40 seconds, a weight between about 10 and 35 grams per square meter, and a filler content in the range of approximately 22 to 35 percent.

6. The process of making a cigarette wrapper comprising coating, with water or in ethyl alcohol, at least part of the surface of a cigarette paper having a Greiner porosity of at least about 50 seconds and a weight between about 10 and 35 grams per square meter, said paper being substantially free of burn accelerator other than filler and having a filler content in the range of approximately 15 to 22 percent.

7. The process according to claim 6 including the step of bringing into contact with the surface of said cigarette paper an additional layer of paper, said additional layer of paper being a cigarette wrapper having a Greiner porosity of about 10 to 40 seconds, a weight between about 10 and 35 grams per square meter, and a filler content in the range of approximately 22 to 35 percent.

8. The process according to claim 6 in which the water of ethyl alcohol carries a linear burn rate-reducing substance and in which the linear burn rate-reducing substance is deposited on or in the paper.

9. The process according to claim 6 in which the water or ethyl alcohol carries a linear burn rate-reducing substance from the group consisting of citric acid, magnesium citrate, magnesium acetate, tartaric acid, acetic acid, lactic acid, a sugar, non-fat milk and skim milk, and in which the linear burn rate-reducing substance is deposited on or in the paper.

10. The process of making a cigarette wrapper comprising coating with a treating liquid at least part of the surface of a cigarette paper having a Greiner porosity of about 10 to 40 seconds, a weight between about 10 and 35 grams per square meter, and a filler content in the range of approximately 22 to 35 percent, the treating liquid being a solution of citric acid, magnesium citrate, magnesium acetate, tartaric acid, acetic acid, lactic acid or a sugar or a suspension of non-fat milk or skim milk.

11. The process according to claim 10 including the step of bringing into contact with the surface of said cigarette paper an additional layer of paper, said additional layer of paper being a cigarette wrapper having a Greiner porosity of about 10 to 40 seconds, a weight between about 10 and 35 grams per square meter, and a filler content in the range of approximately 22 to 35 percent.

12. The process according to claim 10 in which only part of the surface area of the cigarette paper is coated with the treating liquid.

13. The process according to claim 10 in which said soaking step is carried out by the step of applying said treating liquid to a sheet of said cigarette paper over only a part of its surface area, and by the step of treating substantially the entire area of the sheet with a treating liquid, said last-mentioned treating liquid being a solution of citric acid, magnesium citrate, magnesium acetate, tartaric acid, acetic acid, lactic acid or a sugar, or a suspension of non-fat milk or skim milk.

* * * * *